US005255636A

United States Patent [19]

Evans

[11] Patent Number: 5,255,636

[45] Date of Patent: Oct. 26, 1993

[54] AQUEOUS REVERSE-FLOW ENGINE COOLING SYSTEM

[76] Inventor: John W. Evans, 253 Rte. 41 North, Sharon, Conn. 06069

[21] Appl. No.: 907,392

[22] Filed: Jul. 1, 1992

[51] Int. Cl.[5] ..... F01P 3/22

[52] U.S. Cl. ..... 123/41.54; 123/41.29

[58] Field of Search ..... 123/41.54, 41.51, 41.29

[56] References Cited

U.S. PATENT DOCUMENTS 4,352,342 10/1982 Cser et al. ..... 123/41.54

4,550,694 11/1985 Evans ..... 123/41.27

5,111,776 5/1992 Matsushiro et al. ..... 123/41.54

*Primary Examiner*—Noah P. Kamen

*Attorney, Agent, or Firm*—Lyman R. Lyon

[57] ABSTRACT

An aqueous reverse-flow cooling system comprises a pump for delivering coolant to a combustion chamber coolant chamber having a gas outlet, at a high point thereof, for the discharge of coolant and gases through a restriction to a gas separator/condenser circuit having an outlet in fluid communication with a lower pressure area of the coolant circuit.

13 Claims, 1 Drawing Sheet

AQUEOUS REVERSE-FLOW ENGINE COOLING SYSTEM

BACKGROUND OF THE INVENTION

The present invention has particular application to an aqueous, reverse-flow cooling system for an internal combustion engine. The system constitutes a modification of the non-aqueous reverse flow system disclosed in my U.S. Pat. No. 4,550,694 that renders use of an aqueous coolant practical.

U.S. Pat. No. 4,550,694 teaches that in most conditions of operation of an internal combustion engine, coolant boiling takes place around the combustion chamber area typically termed the cylinder head cooling chamber. Coolant vapor produced by such boiling must be accommodated and said patent discloses one method comprising a particular fluid circuit that is suitable for a non-aqueous coolant.

However, if a reverse flow cooling system is operated with an aqueous coolant, for example, a 50/50 ethylene glycol/water solution, the lower molar heat thereof as compared to, for example, non-aqueous propylene glycol, produces considerably more water vapor than the propylene glycol vapor for the same heat load. The increased vapor volume may become trapped in the cylinder head cooling chamber, ultimately displacing coolant in the cylinder head cooling chamber until the pressure of the vapor exceeds the setting of the relief valve. Coolant loss is exhibited during the open phase of the relief valve.

This alternating cycle of building vapor volume and subsequent venting results first in too much coolant vapor in the cylinder head coolant chamber, which is evidenced by "knock," and then venting of coolant vapor resulting in excessive coolant loss.

More particularly, while the existence of noncondensible air and leak-induced combustion gases in the cooling chambers of an engine has long been recognized, the existence and effect of excessive water and coolant vapor in the cooling chamber of an engine has long been recognized, the existence and effect of excessive water and coolant vapor in the cooling chambers of an engine utilizing an aqueous coolant has only recently been recognized. Many of the problems attributed to noncondensible gases are actually caused by water vapor and vaporized coolant. The basic assumption was that water and coolant vapor was generated only when coolant flow ceased during an "after-boil" condition incident to engine shut down. It was further assumed that small amounts of water and coolant vapor, if generated while the engine is running, will move out of the engine with coolant flow into the radiator where it condenses into a liquid.

However, since coolant vapor exists in the cylinder head cooling chambers at all engine loads and conditions, most of the debilitating effects of noncondensible gases, specifically air and combustion gases, are also exhibited by coolant vapor generated at such normal engine loads and conditions.

To understand the engine dynamic that exists in the liquid cooled internal combustion engine due to the physical characteristics of aqueous coolants and the mechanical structure of the liquid cooling system, the characteristics of coolant vapor must be understood.

Although the currently used aqueous coolant, normally one-half ethylene glycol and one-half water (50/50 EGW), exhibits a very low freezing point compared to water, the boiling and condensation characteristics of the solution remain close to those for water. Within the engine cooling system there exists a range in the saturation temperature, or in other words the boiling point and maximum condensation temperature of pure water, from a high, at I atmosphere gauge, of 121° C. (250° F.) down to, at zero psig., 100° C. (212° F.). Because water exhibits a relatively high vapor pressure compared to ethylene glycol, when a 50/50 EGW mixture is boiled, the resultant vapor is more than 98% water vapor by volume. This water vapor will not condense in the coolant when the coolant temperature is above the saturation temperature of water for the system pressure. Ideally, in the conventional 50/50 EGW cooling system, water vapor generated by boiling in the cooling chambers would be condensed into the liquid coolant itself. However, under high load and/or high ambient temperature conditions, when the coolant temperature approaches the saturation temperature of water at a given system pressure, vapor in the cooling jacket cannot condense soon enough to prevent the displacement of coolant. As long as the 50/50 EGW bulk coolant temperature is above the saturation temperature of the water vapor fraction of the coolant, the water vapor fraction suspended in the coolant will persist and accumulate even though it is below the boiling point of the 50/50 EGW mixture. This means that even if the area generating the water vapor is small i.e., a single hot spot such as an exhaust valve seat, and the bulk temperature of the coolant is above the saturation temperature of water at a given system pressure, the water vapor fraction will continue to grow, if not addressed, until system failure occurs. Failure of the conventional 50/50 EGW cooling system is usually in the form of vapor binding of the coolant pump, evidenced by loss of flow, vapor binding of the cylinder head evidenced by severe engine knock, or catastrophic venting evidenced by boil-over.

It is also to be noted that vapor conditions inside the engine cooling chambers are different than conditions in other areas of the liquid cooling system. Large volumes of vapor can be suddenly released from the cooling chambers merely by a reduction in engine RPM after a sustained steady state condition i.e., highway driving. This condition is the result of the coolant pump generating a relatively high system pressure within the coolant chambers. Depending upon coolant flow, which is a function of pump speed, the additional mechanical pressure placed upon the coolant over the bulk system pressure can be as high as 35 to 80 psig. The result is that considerably more coolant vapor is generated at lower than expected system bulk temperature and pressures.

For example, on a moderately warm ambient day, testing has shown that a conventional 50/50 EGW system can stabilize at an engine outlet coolant temperature of 115° C. (240° F.) resulting in a radiator outlet temperature of about 111° C. (232° F.) at a system pressure of approximately 7 psig. The relatively low system pressure is a result of the bulk temperature being below the 50/50 EGW saturation temperature of about 118° C. (245° F.). Although the average temperature in the engine, in theory, would be 113° C. (236° F.) with a temperature gain of 4° C. (8° F.), there are actually areas in the engine coolant chambers, because of localized high heat flux values and static coolant flow areas, which exceed the saturation temperature of 118° C. (245° F.), of the 50/50 EGW at 7 psig. However, because of the mechanical pressure exerted by the pump on coolant within the engine coolant chambers, coolant pressure in said chamber is raised by as much as an additional 35 to 80 psig. Therefore, the saturation temperature of the 50/50 EGW, in the engine coolant chambers, is raised to a point where no vapor is generated. This condition remains stable, with no vapor produced within the engine coolant chambers until the RPM of the engine, and therefore pump speed, are lowered. Immediately upon lowering of the pump speed, the mechanical pressure placed upon the coolant is lowered, as is the resultant saturation temperature of the 50/50 EGW coolant within the engine cooling chambers. Instantaneously vapor is generated at all high heat flux areas and regions of static coolant flow which were only momentarily before kept free of vapor by the increased pressure induced by the higher engine/pump speed. The water vapor fraction produced cannot be condensed as the lowest system coolant temperature is above the condensation temperature of the water vapor or, more specifically, the water vapor generated in the cylinder head cooling chamber is produced at a 50/50 EGW saturation temperature of 118° C. (245° F.) at 7 psig. and the condensation temperature for the water vapor fraction is 111° C. (232° F.) at 7 psig. Therefore, the only way for water vapor, which remains as vapor at the bulk coolant temperature of 115° C. (240° F.) of the system, to be removed from the top of the engine chambers, in current engines utilizing conventional coolant flow direction, is for the water vapor to be carried out of the upper chamber area, to the radiator, continually, until the system temperature is lowered below 115° C. (240° F.). In the engine off load condition, the system temperature must be lowered, below 118° C. (245° F.) in order to effect condensation even though the radiator outlet temperature is low enough, for example, 111° C. (232° F.), to start condensing the water vapor, not taking into account that the pressure depression of the pump draw would actually lower the required condensation temperature below 111° C. (232° F.) at that point.

If coolant flow is reversed in a currently mass produced engine so as to flow from the outlet side of the pump to the engine cylinder head cooling chamber, down through the internal passages in the engine block into the lower cylinder block cooling chamber, and thence out of the lower chamber to the inlet side of the pump, the system would work only if cooling jacket vapors and noncondensible gases are totally eliminated. This is contrary to the reality of liquid cooled engine operation. In reality, reversal of coolant flow aggravates problems associated with water and coolant vapor formed when the coolant temperature inhibits condensation. Because of, primarily, the force of the reverse flow coolant entering high into the cylinder head cooling chamber, such vapors and noncondensible gases cannot exit the chamber while the engine is running, since the flow of coolant downwardly through passages in the block tends to bias the gases toward the block cooling jacket. Moreover, secondly, in the mechanical sense, coolant velocity through the block passages is insufficient for the coolant to carry the gases completely downward. Stated in another manner, natural buoyancy of the gases will overcome the downward coolant flow and the gases will rise into the upper portion of the cylinder head coolant chamber progressively displacing more and more coolant as the vapor fraction of the chamber increases.

After a period of time, a significant and potentially damaging accumulation of trapped vapor and other gases may occur in the cylinder head cooling chamber. For example, 10 grams (0.35 oz) of water, vaporized in the cylinder head cooling chamber produces 12.3 liters (3.25 gallons) of vapor. Without a means to remove the uncondensed vapors from the cylinder head jacket as they enter the chamber or are generated within the jacket, a steady and oftentimes rapid displacement of coolant occurs. As the displacement of coolant from the cylinder head cooling chamber continues, due to the water and coolant vapor fractions expanding and backing liquid coolant out into the radiator, pressure rises at the vent, typically found at the top of the radiator, and coolant is released from the system into the atmosphere when the vent setting is exceeded. As the generation of gases in the cylinder head cooling chamber continues, displacement of coolant causes the gaseous fraction of the chamber to increase until the loss of coolant volume progresses to a level where heat exchange values of metal to coolant, are imbalanced and excessive boiling occurs. The boiling rapidly passes from a nucleate boil condition to a film boiling state and finally to a superheated boiling condition wherein a major portion of the cylinder head cooling chamber is filled with vaporized coolant and violent venting of the system occurs. If the engine is not shut off during such a period of "vapor-binding" of the cylinder head cooling chamber, engine damage may result.

The conventional cooling system found in today's engines, ameliorates the aforesaid situation by utilizing upward flow of coolant from the engine block coolant chamber to the cylinder head coolant chamber. Thus, the natural buoyancy of the coolant vapor helps remove surface vapor by "lifting and scrubbing" the vapor off the surface of the coolant chambers. The "lift and scrub" action tends to maintain the surface vapor condition in a reasonably controlled state, notwithstanding the fact that vapor generated by aqueous coolants has a relatively high surface tension characteristic, for example, from 56 to 70 dynes/cm at 25° C. and tends to "cling," evidencing nucleate or film boiling, to the metal surface of the cylinder head coolant chamber.

The aforesaid "saving" feature of conventional coolant flow direction does not obtain when the coolant flow is reversed whereby coolant enters the cylinder head coolant chamber and flows downwardly into the cylinder block coolant chamber exerting a downward pressure against the natural buoyancy of the coolant vapor and other gases, decreasing the tendency of the vapor to break loose from the metal surfaces of the coolant chambers.

SUMMARY OF THE INVENTION

The aforesaid problems experienced in reversing the flow of an aqueous coolant cooling system are solved, in accordance with a constructed embodiment of the instant invention, by utilizing the dynamics of the coolant pump and a unique fluid circuit to create a pressure differential that augments separation and condensation of coolant vapor and the removal of other gases. Coolant pressure within the cylinder head coolant chamber is directly elevated by the pump. This dynamic is utilized in conjunction with a fluid flow restriction upstream of an externally mounted gas separator/condenser to separate all gases, i.e., coolant vapor and noncondensible gas, to control coolant flow, and condense coolant vapor for return to the cooling system as a fluid.

Coolant vapor accumulated in the cylinder head cooling chamber exits through a vent therein located at a high point in the cylinder head cooling chamber. Venting is carefully restricted so as to vent only a relatively small amount of liquid coolant along with the coolant vapor and other gases. The vent in the cylinder head cooling chamber is connected, through the flow restriction, to the separator/condenser. A liquid coolant return line extends from the separator/condenser to a lower pressure area in the engine cooling chambers or in the circuitry of the cooling system. A critical feature is that a pressure differential created by the pump is maintained between the cylinder head cooling chamber and the separator/condenser by the fluid flow restriction whereby expansion of the coolant vapor upon entry to the separator/condenser effects cooling and condensation thereof. Gas entrapment in the cylinder head cooling chamber is precluded by locating the cooling chamber vent at a high point in the cylinder head cooling chamber and connecting the vent through the flow restricted passage to an inlet of the separator/condenser.

DETAILED DESCRIPTION OF THE PREFERRED EMBODIMENTS OF THE INVENTION

Figure 1:
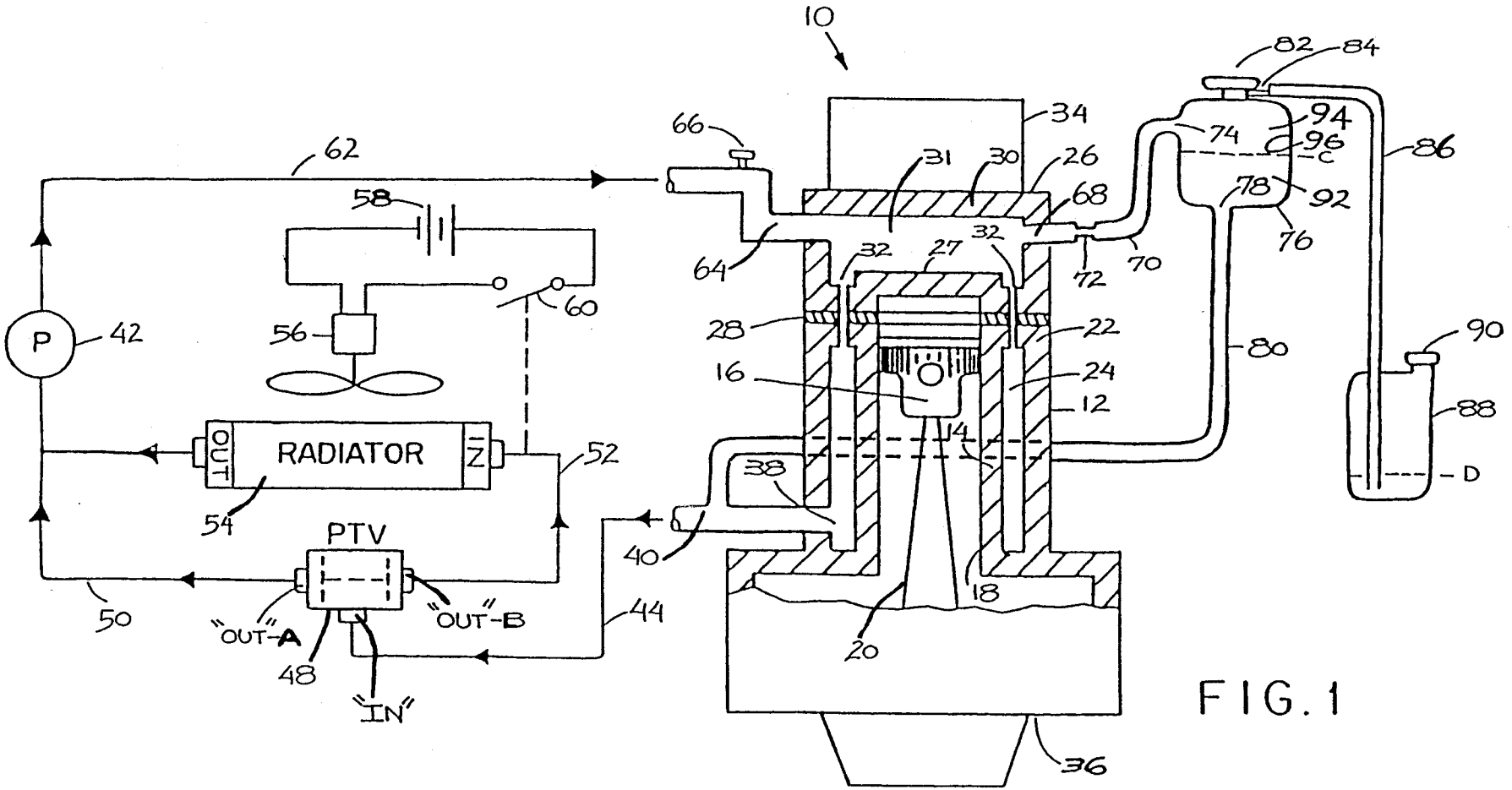
FIG. 1 is a schematic view, partially in section of the cooling system of the present invention applied to a conventional internal combustion engine.

As seen in FIG. 1, an internal combustion engine embodying the cooling system of the present invention is indicated generally by the reference numeral 10. The engine 10 is hereinafter described with reference to a motor vehicle (not shown), but can be used in other applications. The engine 10 comprises an engine block 12 having a cylinder wall 14 formed therein. A piston 16 reciprocates within a complementary cylinder bore 18. The piston 16 is coupled to a crank shaft (not shown) by a connecting rod 20.

A block coolant jacket 22 surrounds the cylinder wall 14, and is spaced therefrom so as to define a block coolant chamber 24 therebetween. The block coolant chamber 24 accommodates coolant flow therethrough to cool the metal surfaces of the engine 10.

The preferred coolants used in this system are primarily aqueous in their physical characteristics and may comprise 100% water or a mixture of water and antifreeze compounds, normally up to 60% by volume, as is generally practiced in today's engines. Such antifreeze compounds are usually formulated from ethylene glycol or propylene glycol.

A combustion chamber 25 is defined by a cylinder head 26 having a combustion chamber dome 27 therein disposed above the cylinder bore 18. A head gasket 28 is seated between the cylinder head 26 and the engine block 12. The cylinder head 26 includes an upper jacket portion 30 which, in conjunction with the combustion chamber dome 27, defines a head coolant chamber 31. The head gasket 28 seals the combustion chamber 25 from the coolant chamber 31 and, likewise, seals the coolant chamber 31 from the exterior of the engine 10.

A plurality of coolant ports 32 extend through the base of the cylinder head 26, through the head gasket 28, and through the top of the block coolant jacket 22. A valve cover 34 is mounted on top of the cylinder head 26. The engine 10 further comprises an oil pan 36 mounted to the bottom of the block 12 to hold the engine's oil.

In accordance with the present invention, engine coolant flows from the head coolant chamber 31, through the coolant ports 32, and into the block coolant chamber 24. Coolant then flows from the block coolant chamber 24 through coolant lines 40 and 44 to a proportional thermostatic valve (PTV) 48. An outlet "A" of the PTV 48 is coupled to a radiator bypass line 50 leading to the inlet side of a pump 42. The size of the pump 42 is determined to achieve the coolant flow rates required under operating loads.

An outlet "B" of the thermostat 48 is coupled to a radiator line 52. The PTV 48 is set to detect a threshold temperature of the coolant flowing through the coolant line 44. If the temperature of the coolant is below the threshold, the PTV 48 directs a proportional amount of coolant through the bypass line 50. If, on the other hand, the coolant temperature is above the threshold, the PTV 48 directs the coolant into the radiator line 52.

The other end of the radiator line 52 is coupled to a radiator 54. An electric fan 56 is mounted in front of the radiator 54 and is powered by a vehicle battery 58. The fan 56 is controlled by a thermostatic switch 60 which is coupled to the radiator line 52. Depending upon the temperature of the coolant in the radiator line 52, the thermostatic switch 60 operates the fan 56 to increase the airflow through radiator 54, and thus increase the heat exchange with the hot coolant.

Both the output of the radiator 54 and the bypass line 50 are coupled to the inlet side of the pump 42, the outlet side of which is connected to a coolant return line 62. The coolant return line 62 is in turn coupled to an input port 64 in a top wall 30 of the cylinder head 26. Thus, depending upon the temperature of the coolant flowing through the coolant line 44, the coolant flows either through the bypass line 50 or the radiator 54, which are both in turn coupled, through the pump 42, to the return line 62. For example, during engine warm-up when the coolant temperature is relatively low, the coolant is directed by the PTV 48 through the bypass line 50. However, once the engine is warmed-up, at least some of the coolant is usually directed through the radiator 54. The lower temperature coolant flowing through the input line 62 flows through the input port 64 and into the cylinder head coolant chamber 31. The radiator 54 is chosen to accommodate desired coolant flow rates.

It should be noted that the radiator 54 is not required to retain gases or vapor to the extent required in known systems and, therefore, does not have to be positioned above the highest level of the engine coolant.

An air bleed valve 66 is mounted on the input line 62 above the input port 64 to bleed air from the engine cooling system when filling the system with coolant. The air bleed valve 66 must be located at or above the highest coolant level in the engine to efficiently purge the engine 10 of trapped air when it is initially filled with coolant.

In accordance with one feature of the present invention, a vent 68 is provided at the highest point of the cylinder head coolant chamber 31. The vent 68 is connected to a vent line 70 which is either of relatively small inside diameter or, alternately, contains an in-line restrictor 72. The other end of the line 70 is connected to an inlet port 74 of a separator/condenser 76. The restrictor 72 maintains a pressure differential between the cylinder head chamber 31 and the vapor separator/- condenser 76 as well as limiting the flow of coolant through line 70 to a minor fraction thereof while permitting a major fraction of the coolant vapor collected in the head chamber 31 to pass to the separator/condenser 76. Operation of the vapor/gas separator/condenser 76 will be described below.

A liquid outlet port 78 is positioned at a lowermost portion of the separator/condenser 76 and connects to a liquid coolant return line 80 which has its other end connected to a low pressure area of the cooling system, for example, coolant line 40, in which pressure is reduced by the suction of coolant pump 42.

An integral pressure relief valve and radiator cap 82 is mounted at the top of the separator/condenser 76 and is preset, typically, to a pressure of about 14 psig. The lower portion of the separator/condenser 76 is normally filled with coolant (level C), as will be further described below. A pressure relief vent tube 84, passes any liquid or gases vented by the pressure cap 82, through a vent line 86 to a coolant reservoir 88. Normally, the discharge end of the vent line 86 is maintained below the level of coolant in the reservoir 88, (level D). A reservoir cap 90 is normally vented to atmosphere and the reservoir 88 is operated in a nonpressurized mode.

As discussed earlier, in many operating conditions of an engine, condensible coolant vapor, or other gases, may persist in the block cooling chamber 24 or the cylinder head coolant chamber 31. The dynamics of a reverse flow cooling system preclude such gases from being carried away by reverse-flow of the coolant down through the block and out to the radiator. This phenomenon is the primary defect of reverse-flow cooling and why, until the teaching of the present invention, no true aqueous reverse-flow engine cooling system has been employed by engine manufacturers, vehicle O.E.M.'s, or others.

In accordance with the present invention, the separator/condenser 76 and associated fluid circuitry, solves the aforesaid problem when conditions occur within the engine that produce coolant vapor or other gases in the cylinder head coolant chamber 31.

When such condensible vapors or other gases accumulate in the head coolant chamber 31, the gases will rise to the top of the chamber 31 and immediately exit through vapor port 68. Flow is established out of the port 68 through line 70 to the separator/condenser 76 due to a pressure differential in the coolant system created by the pump 42. The pump 42 effects a positive mechanical pressure on liquid coolant entering the cylinder head coolant chamber 31 and creates a negative pressure on coolant in line 40 which in turn draws on line 80 which is attached to, and draws from the separator/condenser 76. Line 80 may be attached at a location, other than line 40, as long as coolant pressure at the attach point is at a lower pressure than the pressure of coolant in head chamber 31.

Operation of the separator/condenser 76 and associated fluid circuit is as follows: the coolant gas/vapor/liquid coolant is drawn out of chamber 31 with minimum coolant flow, through port 68, restrictor 72, and line 70, through port 74 and into separator/condenser 76. The separator/condenser 76 is filled with coolant, at a minimum, to level C. Upon entering the separator/condenser 76 coolant vapor is separated from the liquid coolant, expanded and therefore cooled which enhances condensation. The incoming liquid coolant and condensed vapor combine with liquid coolant in the bottom of separator/condenser 76 and then flow out port 78 into line 80.

By the aforesaid action only 100% liquid coolant, free of gases, will return to the cooling circuit by way of line 80. The separator/condenser 76 is preferably located in an area detached from the engine whereby the underhood environment will allow it to remain at a temperature at or below the condensation point of water vapor at system pressure. When this condition obtains, the coolant vapors that rise to the top of the separator/condenser 76 will condense and be added to the liquid coolant therein and returned to the cooling circuit. Noncondensible gases (combustion leaks and air) will also rise to the top of separator/condenser 76. However, such gases will remain and accumulate as they cannot pass down and out port 78, and ultimately will be vented through pressure cap 82, at such time there is a rise in system pressure beyond the value of cap 82 or at subsequent "start-up" after the system is "cooled-down". This will be accomplished by the typical action of a conventional bi-directional pressure cap 82. During "cool-down" contraction of the engine coolant draws reserve coolant from the coolant reservoir 88 up through line 86 and into separator/condenser 76 through vent connection 84. No vacuum will be created in reservoir 88 due to cap 90 being open to atmosphere. The noncondensible gases remain at pressure cap 82 after total cool-down and, at subsequent start-up, will be forced by the expanding coolant out of the pressure cap 82 through line 86 into reservoir 88 and released to atmosphere. Except in the case of a failed engine component, noncondensible gases exist in small volumes. Thus, purging at subsequent start-ups is adequate for proper operation of the engine. Coolant vapor volumes are normally within the capabilities of the separator/condenser 76. However, the following features of the system are unique in that they assist in reducing the coolant volume passed out of head chamber 31 to separator/condenser 76.

The restrictor 72 between port 68 and the inlet port 74 to the separator/condenser 76 should be sized to permit only a minimum flow of coolant through line 70 sufficient to remove trapped vapor from the head chamber 31, at any operating mode, and no larger. It is important to note that a minimum amount of coolant flow to the separator/condenser 76 is necessary, when vapor is present, in order to avoid "dead-heading" of vapor line 70 or, in other words, blockage of vapor transfer from chamber 31 to separator/condenser 76. It is also necessary that the outlet of the coolant return line 80, be connected at a point in the system that exhibits a lower pressure than system pressure at vapor exit port 68 in order for there to be flow through line 70 and vapor transfer from chamber 31 to the separator/condenser 76. The separator/condenser 76 circuit is effectively a by-pass circuit of the engine cooling chambers 31 and 24. Therefore, coolant which passes through the circuit should be minimized so as to not significantly reduce the volume of coolant passing through the engine cooling chambers 31 and 24, thereby reducing heat rejection from the engine, and also causing a loss in the critical heat exchange.

The use of the restrictor 72, as described previously, limits the amount of coolant which will by-pass the cooling chambers 31 and 24 and therefore be unavailable to absorb and carry heat away from the coolant chamber walls 14 and 22.

It is also to be noted that the restrictor 72 minimizes the transfer of heat to the separator/condenser 76. Coolant passing through line 70 into the separator/condenser 76, of minimum volume, when controlled by the restrictor 72, will not carry, or transfer excess heat to the liquid portion 92 or the space 94, of the separator/condenser 76. The slow passage of liquid coolant through port 74 into the separator/condenser 76 and out through port 78 is established so that the total loss of heat, from the liquid to the walls 96 of the separator/condenser 76 and out to atmosphere is always superior to the total heat value which enters into the separator/condenser 76 through port 74 during any given time frame. As long as the established coolant flow, through the separator/condenser 76, and the loss to atmosphere are properly balanced, the operating temperature of the separator/condenser 76 will be maintained below the condensation temperature of water vapor at a given system pressure.

Another feature of the restrictor 72 is to condition the coolant vapor for expansion upon passing thereof through port 74 into the larger internal area of the separator/condenser 76. Such expansion, which is a function of the relatively lower operating pressure in the separator/condenser 76 caused by coolant pump draw at port 78, will cause the coolant vapor to expand, slow-down, and lose heat energy to the wall 96 of the separator/condenser 76, which exchanges the heat to atmosphere. When the temperature of the coolant vapor passes below its saturation temperature, the vapor will condense and be returned as coolant liquid to the reserve coolant 92.

In most cases the simple hollow tank design of the separator/condenser 76 will be adequate for complete condensation of coolant vapor at normal operating loads. If, however, increased heat exchange capabilities are required, the addition of cooling fins to the wall 96 will dramatically increase the condensing capacity of the separator/condenser 76.

The separator/condenser 76 may be mounted at any desired elevation relative to the engine or cooling system because operation thereof is a function of the coolant flow through it, as metered by the restrictor 72, and is not dependent upon the ability of the vapor to rise up from the engine. Thus, the separator/condenser 76 can be located below the engine or cooling system. However, when design criterion permits, the preferred location is the slightly elevated location shown in FIG. 1 of the drawings, since when the separator/condenser 76 is mounted at a location equal to or above the highest point of the engine cooling system it will also function as an elevated filling tank and assist greatly in the purging of air during the initial filling of the cooling system with coolant through the head pressure the reserve coolant exerts through line 80 upon the manual air bleed 66 (and other bleeds if installed) which are temporarily opened during the initial filling of coolant.

If desired, the entire cooling system including the expansion reservoir 88 can be pressurized and closed to atmosphere. This is accomplished by replacing the pressure cap 82 with a cap which places vent port 84 in open communication with the separator/condenser tank 76 at all times. A pressure cap, typically set at 14 to 17 psig., would then be installed in place of the open vented cap 90 on the reservoir 88. The reservoir 88, line 86 and all connections would have to be sufficiently strong to withstand the pressure under which they would then operate.

In the above described system, the restrictor 72 can be eliminated by properly sizing the ID of line 70 or employing a flow control system which creates a pressure differential between the outlet 68 in the cylinder head chamber 31 and the outlet 78 in the separator/condenser 76 whereby coolant vapor and liquid coolant exits the chamber 31 where it is at a higher pressure, expands upon entering the separator/condenser 76, condenses, and exits the outlet 78 therein at all operating speeds and coolant flow rates of the pump 42. The differential pressure required for coolant vapor flow can be as low as, for example, 0.5 psig.

In some instances, for example, when the separator/condenser 76 is mounted in an elevated location, the coolant reservoir 88 may be eliminated. By employing an air space 94 in the separator/condenser 76 of sufficient size above the coolant portion 92 to allow for coolant expansion and vapor volumes at varying heat levels and loads, reserve coolant may be contained within the separator/condenser 76. The space must be great enough to assure that the liquid level "C" does not reach the vent outlet port 84 under any operating condition of the engine.

While the preferred embodiment of the invention has been disclosed, it should be appreciated that the invention is susceptible of modification without departing from the scope of the following claims.

I claim:

1. An aqueous reverse flow cooling system for an internal combustion engine comprising:

a coolant chamber for the combustion chamber of said engine, said coolant chamber having an inlet for the admission of coolant, a first outlet for the discharge of a major fraction of the coolant, and a second outlet disposed at a high point of said coolant chamber, for the discharge of a minor fraction of said coolant and a major portion of gases from said coolant chamber, a coolant pump having an outlet in fluid communication with the inlet to said coolant chamber, a gas separator/condenser having an inlet in fluid communication with the second outlet from said coolant chamber and an outlet at a point relatively low in said gas separator/condenser in fluid communication with the low pressure side of said pump, and means disposed between the second outlet in said coolant chamber and said gas separator/condenser for controlling the flow of coolant and gases from said coolant chamber to said gas separator/condenser so as to maintain the pressure upon the coolant and gases in said coolant chamber above the pressure upon the coolant and gases in said gas separator/condenser.

2. A cooling system in accordance with claim 1 wherein said control means comprises a conduit between the second outlet in said coolant chamber and said gas separator/condenser having a smaller inside diameter than the inside diameter of the conduit between the outlet of said gas separator/condenser and the low pressure side said pump.

3. A cooling system in accordance with claim 1 wherein said means comprises a restriction in the conduit between the second outlet in said cooling chamber and said gas separator/condenser.

4. A cooling system in accordance with claim 1 wherein the first outlet in said combustion chamber coolant chamber communicates with a cylinder block coolant chamber internally of said engine and the outlet of said gas separator/condenser is connected to a lower pressure area of said cylinder block coolant chamber.

5. A cooling system in accordance with claim 1 wherein said gas separator/condenser is positioned at a higher level than said coolant chamber.

6. A cooling system in accordance with claim 1 wherein a normally closed coolant vapor and noncondensible gas vent is provided at a high point of said gas separator/condenser.

7. A cooling system in accordance with claim 6 wherein said vent is connected to a coolant reservoir.

8. A cooling system in accordance with claim 7 wherein said reservoir is normally maintained at ambient pressure.

9. A cooling system in accordance with claim 7 wherein said vent communicates with said reservoir through a conduit having one end connected to said vent and an opposite end disposed below the level of coolant in said reservoir.

10. A method of cooling an internal combustion engine comprising the steps of:

pumping an aqueous liquid coolant under an elevated pressure from the outlet side of a pump to a coolant chamber for the combustion chamber of said engine, venting a major fraction of gases and minor fraction of the liquid coolant residing in said coolant chamber from a high point in said coolant chamber to a gas separator/condenser circuit, controlling the flow of gases and liquid coolant between said coolant chamber and said gas separator/condenser circuit so as to maintain the pressure upon the gases and liquid coolant in said coolant chamber above the pressure upon the gases and liquid coolant in said gas separator/condenser circuit, expanding the coolant vapor to a relatively lower pressure in at least a portion of said gas separator/condenser circuit, cooling the coolant vapor to a relatively lower temperature in at least a portion of said gas separator/condenser circuit, condensing said coolant vapor to a liquid in at least a portion of said gas separator/condenser circuit, and returning liquid coolant from a low point in said gas separator/condenser circuit to a lower pressure area of the coolant circuit.

11. An aqueous reverse flow cooling system for an internal combustion engine comprising:

a coolant chamber for the combustion chamber of said engine having an inlet for the admission of liquid coolant and a gas outlet, at a high point therein, for the discharge of liquid coolant and gases, from said coolant chamber, a liquid coolant pump having an outlet in fluid communication with the inlet to said coolant chamber, a gas separator/condenser having an inlet in fluid communication with the gas outlet of said coolant chamber and an outlet at a point relatively low in the said gas separator/condenser in fluid communication with a lower pressure area of the coolant circuit, and a pressure and flow restriction between said coolant chamber and said gas separator/condenser for limiting flow of gases and liquid coolant from said coolant chamber to said gas separator/condenser and maintaining the pressure upon said gases and liquid coolant in said coolant chamber above the pressure upon said gases and liquid coolant in said gas separator/condenser.

12. An aqueous reverse flow cooling system for an internal combustion engine comprising:

a coolant chamber for the combustion chamber of said engine having an inlet for the admission of liquid coolant, and a gas outlet, the outlet communicating with a high point in said coolant chamber for the discharge of a major fraction of gases and a minor fraction of the liquid coolant from said coolant chamber, a liquid coolant pump for producing an elevated coolant pressure at the inlet to said coolant chamber, a gas separator/condenser having an inlet in fluid communication with the gas outlet of said coolant chamber and an outlet at a point relatively low therein in communication with an area of the coolant circuit on the low pressure side of said coolant pump, and means disposed between said coolant chamber and said gas separator/condenser for maintaining the pressure upon the gases and liquid coolant in said coolant chamber above the pressure of the gases and liquid coolant in said gas separator/condenser.

13. An aqueous reverse flow cooling system for an internal combustion engine comprising:

a coolant chamber for the combustion chamber of said engine, said combustion chamber coolant chamber having an inlet for the admission of coolant and a removal point within the uppermost half thereof, for the discharge of a minor fraction of coolant and a major fraction of gases, from said coolant chamber, a coolant pump having an outlet in fluid communication with the inlet to said coolant chamber, a gas separator/condenser having an inlet in fluid communication with the removal point outlet of said coolant chamber and an outlet at a point relatively low in the said gas separator/condenser in fluid communication with an area of the coolant circuit which is at a lower pressure than the said combustion chamber coolant chamber, and means disposed between said coolant chamber and said gas separator/condenser lower pressure communication point for controlling the flow of coolant and gases from said coolant chamber to a gas separator/condenser circuit so as to maintain the pressure upon the coolant and gases in said coolant chamber above the pressure upon the coolant and gases in at least a portion of the said gas separator/condenser circuit.

* * * * *